US008148903B2

(12) United States Patent
Pang

(10) Patent No.: US 8,148,903 B2
(45) Date of Patent: Apr. 3, 2012

(54) LIGHT EMITTING DIODE DRIVING CIRCUIT

(75) Inventor: Sung-Man Pang, Gwangmysong-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 847 days.

(21) Appl. No.: 12/141,577

(22) Filed: Jun. 18, 2008

(65) Prior Publication Data

US 2008/0315773 A1 Dec. 25, 2008

(30) Foreign Application Priority Data

Jun. 21, 2007 (KR) ..... 10-2007-0061000

(51) Int. Cl.
*H05B 37/02* (2006.01)

(52) U.S. Cl. ..... 315/151; 315/158; 315/307

(58) Field of Classification Search ..... 315/151, 315/158, 291, 307, 308, 312, 224, 149; 345/76–78, 345/102; 362/612, 800
See application file for complete search history.

(56) References Cited

U.S. PATENT DOCUMENTS

| | | | | |
|---|---|---|---|---|
| 6,069,676 | A * | 5/2000 | Yuyama | 349/62 |
| 6,127,783 | A * | 10/2000 | Pashley et al. | 315/149 |
| 6,630,801 | B2 * | 10/2003 | Schuurmans | 315/307 |
| 6,690,146 | B2 | 2/2004 | Burgyan | |
| 6,753,661 | B2 * | 6/2004 | Muthu et al. | 315/307 |
| 6,894,442 | B1 * | 5/2005 | Lim et al. | 315/291 |
| 7,348,960 | B2 * | 3/2008 | Huang et al. | 345/102 |
| 2006/0006821 | A1 | 1/2006 | Singer et al. | |
| 2006/0038509 | A1 * | 2/2006 | Lin et al. | 315/291 |
| 2006/0082538 | A1 | 4/2006 | Oyama | |
| 2006/0187180 | A1 | 8/2006 | Park et al. | |
| 2007/0296887 | A1 * | 12/2007 | Nakao et al. | 349/62 |

FOREIGN PATENT DOCUMENTS

| | | |
|---|---|---|
| JP | 56-105685 | 8/1981 |
| JP | 07-329349 | 12/1995 |
| JP | 2006-222376 | 8/2006 |
| JP | 2007-134405 | 5/2007 |
| KR | 10-2006-0051657 | 5/2006 |
| KR | 10-2006-0094181 | 8/2006 |

OTHER PUBLICATIONS

Maxim Datasheet for MAX8631 (May 2006).
Analog Devices Datasheet ADM8843 (2006).
"Optical Feedback Extends White LEDs' Operating Life", EDN, Jan. 18, 2007, pp. 84-88.

* cited by examiner

*Primary Examiner* — Jacob Y Choi
*Assistant Examiner* — Ephrem Alemu
(74) *Attorney, Agent, or Firm* — Sherr & Vaughn, PLLC

(57) ABSTRACT

A LED driving circuit that may control current flow into an LED on a current path according to the amount of light sensed from the LED. An LED driving circuit for driving at least one LED may include at least one of: An optical sensor for receiving light emitted from the LED and generating a feedback signal having a level corresponding to an amount of the received light. A current regulator provided on a path through which current of the LED flows for regulating an amount of current flowing into the LED according to a comparison of the feedback signal with a first reference signal.

16 Claims, 7 Drawing Sheets

LIGHT EMITTING DIODE DRIVING CIRCUIT

The present application claims priority under 35 U.S.C. 119 to Korean Patent Application No. P10-2007-0061000 (filed on Jun. 21, 2007), which is hereby incorporated by reference in its entirity.

BACKGROUND

Embodiments relate to a light emitting diode (LED) and/or a LED driving circuit. White LEDs may be used for illumination (e.g. a backlight unit of a mobile communication device). When applying LEDs to mobile communication devices, it may be desirable for LEDs to have relatively low power consumption in order for them to be used for a relatively long period of time. It may be desirable for a LED driving circuit to maintain a consistent level of light emitted from LEDs.

The amount of light emitted from an LED may be determined as a function of current and temperature supplied to the LED, irrespective of an emitting color. The brightness of a LED may be non-linearly reduce during operation. For example, the brightness of a white LED may be decrease after a prescribed time elapses. Even though the same current may flow into a LED, the brightness of the LED may change due to changes in ambient temperature of the LED during operation.

LEDs mounted in a backlight unit may have a serial and/or parallel structure. When the LEDs are simultaneously driven, the amount of light from the LEDs should be maintained relatively constant by supplying the same current to each of the LEDs.

An example LED driving circuit for driving a white LED may utilize a charge pump. A LED driving circuit may sense the amount of voltage applied to the LED and/or a voltage across both ends of the LED and control the amount of voltage applied to the LED using the sensed voltage. However, such an LED driving circuit may having limitations in keeping the amount of light emitted from the LED reasonably constant.

A LED driving circuit may receive light emitted from an LED and controlling the driving of the LED by using a received result (e.g. sensed light) as feedback. A light sensing LED driving circuit may require at least two integrated circuits (ICs) plus other peripheral devices (e.g. a Schottky diode and an inductor) in a peripheral region of the ICs. Accordingly, the number of components in a light sensing LED driving circuit may be relatively large, which may increase costs and size of the light sensing LED driving circuit.

SUMMARY

Embodiments relate to a LED driving circuit that may control current flow into an LED on a current path according to the amount of light sensed from the LED. In embodiments, an LED driving circuit for driving at least one LED may include at least one of: An optical sensor for receiving light emitted from the LED and generating a feedback signal having a level corresponding to an amount of the received light. A current regulator provided on a path through which current of the LED flows for regulating an amount of current flowing into the LED according to a comparison of the feedback signal with a first reference signal.

DRAWINGS

Figure 1:
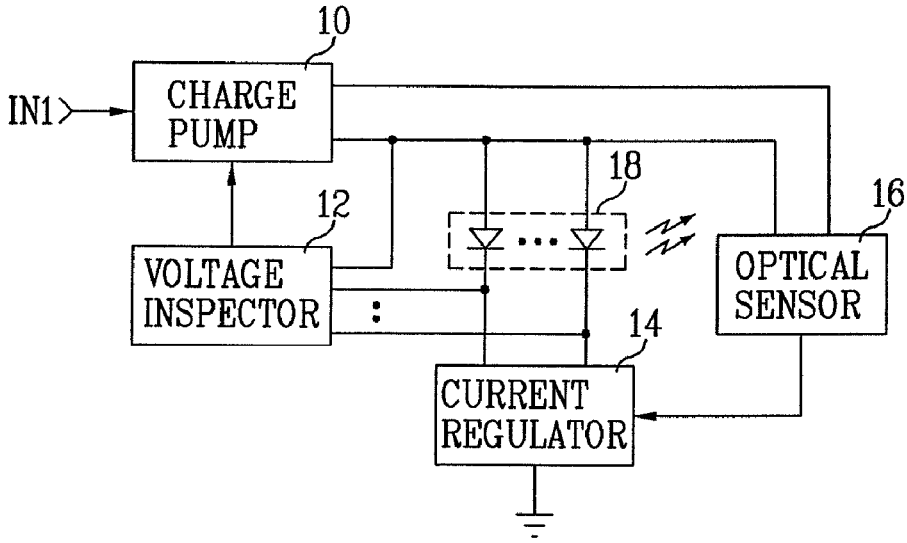

Example FIG. 1 is a schematic block diagram of an LED driving circuit, according to embodiments.

Figure 2:
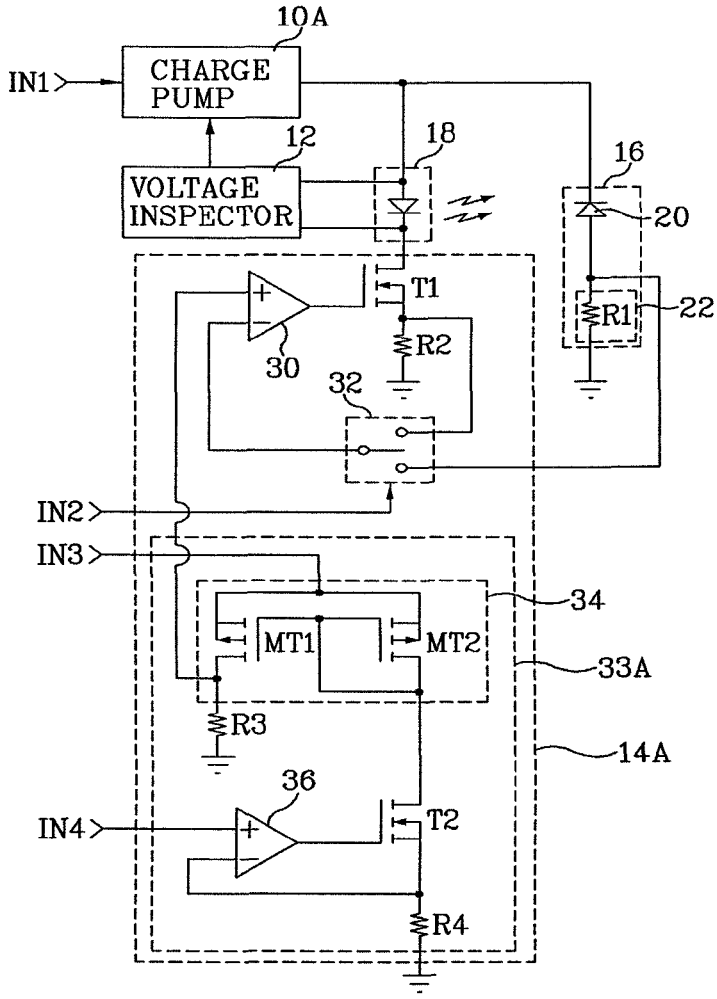

Example FIG. 2 is a circuit diagram of an LED driving circuit, according to embodiments.

Figure 3:
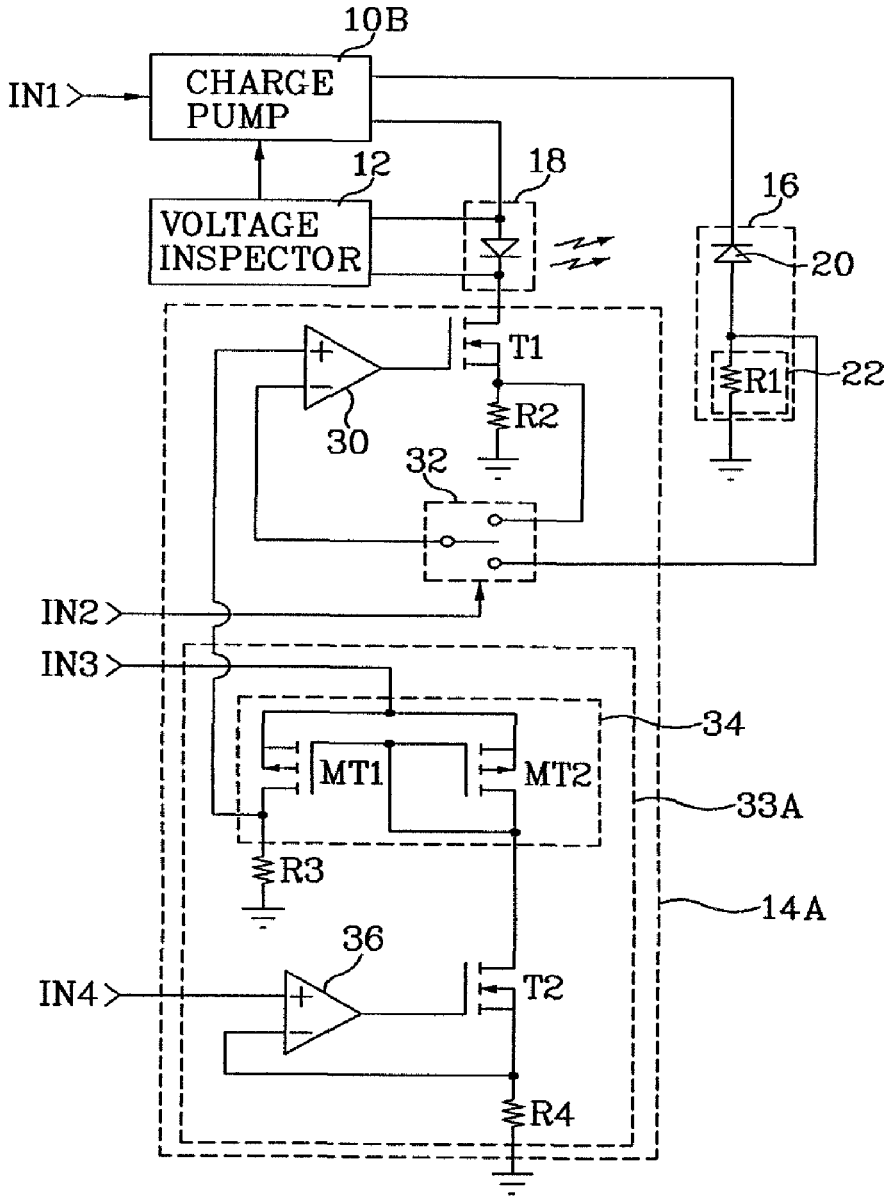

Example FIG. 3 is a circuit diagram of an LED driving circuit, according to embodiments.

Figure 4:
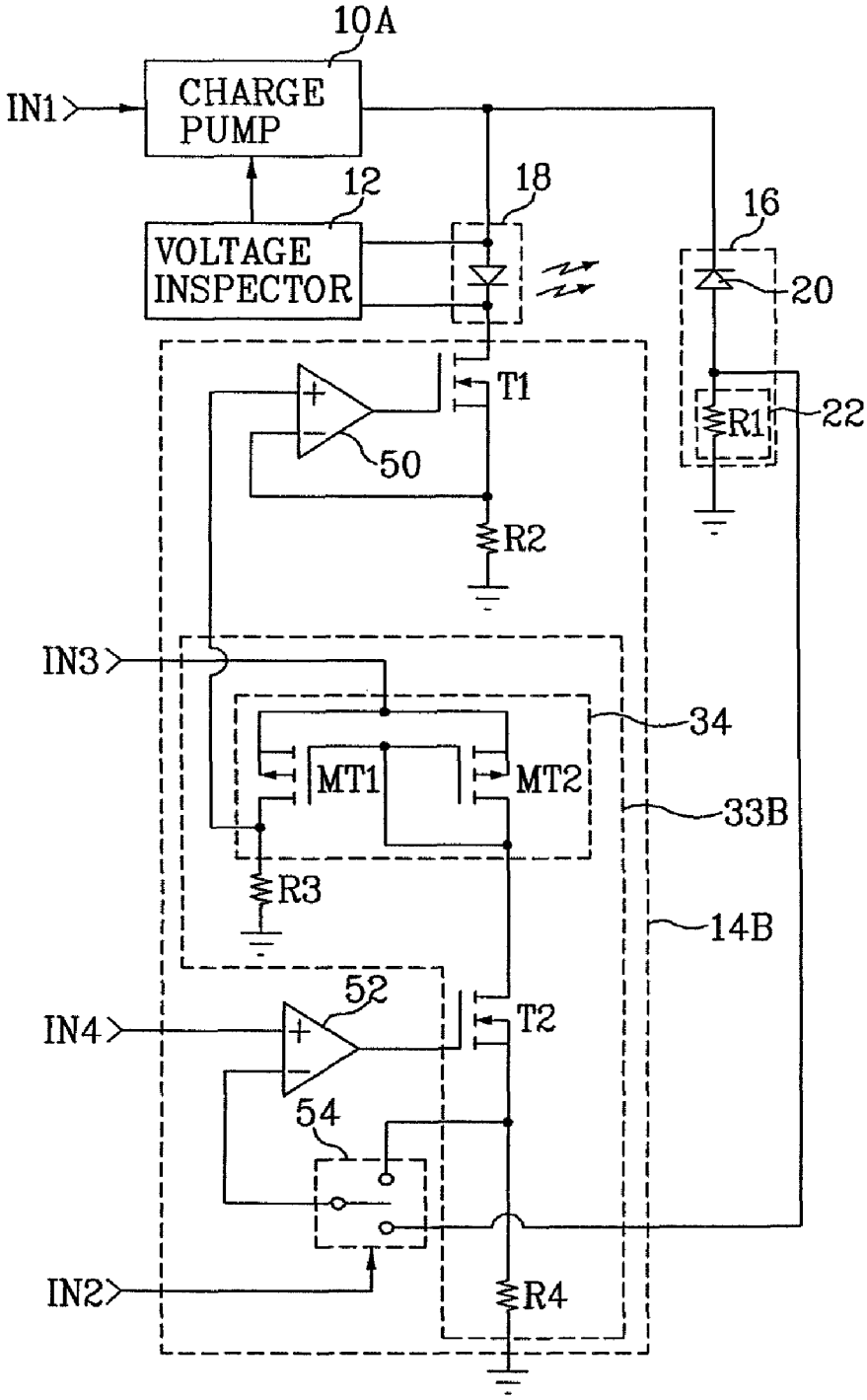

Example FIG. 4 is a circuit diagram of an LED driving circuit, according to embodiments.

Figure 5:
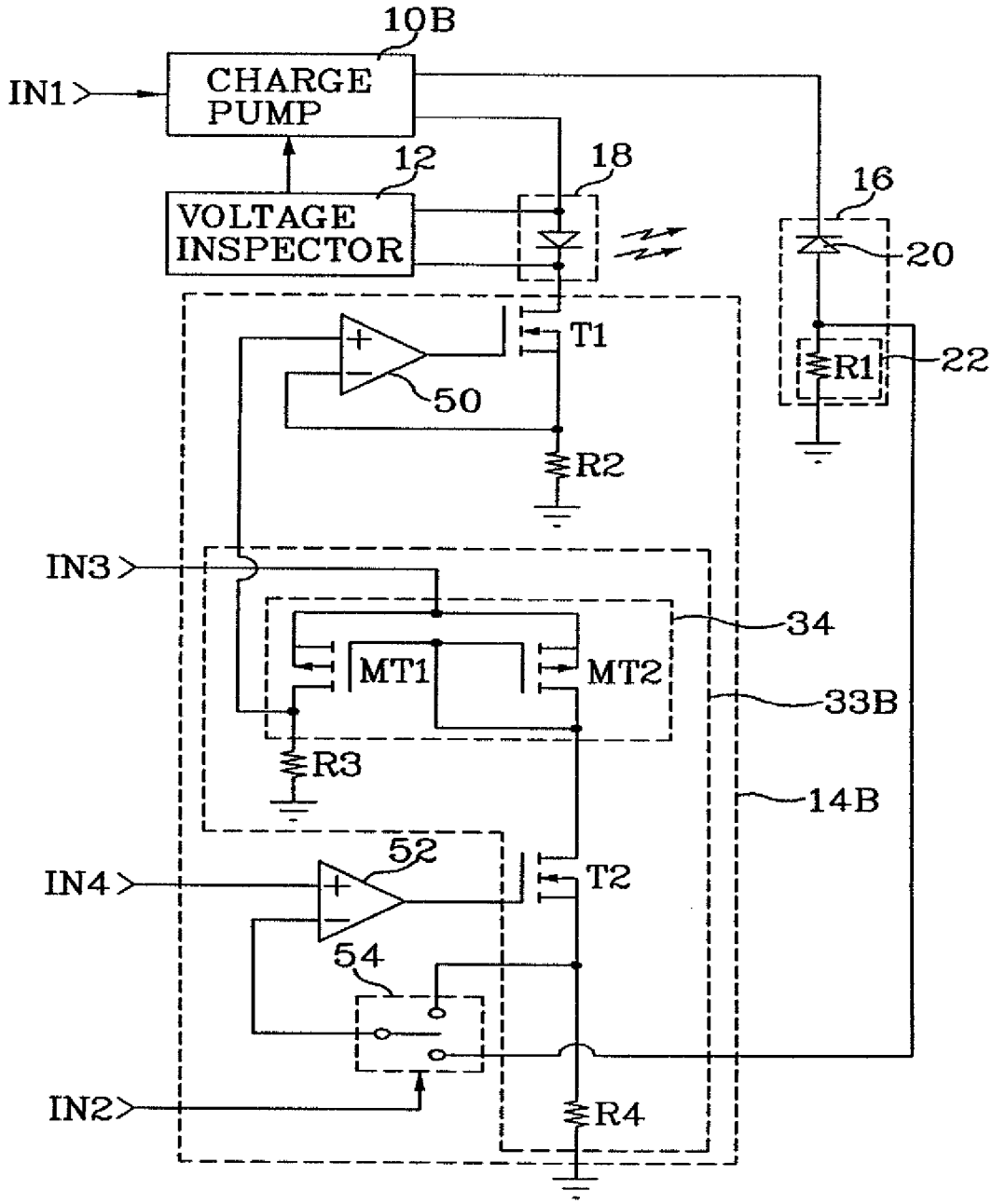

Example FIG. 5 is a circuit diagram of an LED driving circuit, according to embodiments.

Figure 6:
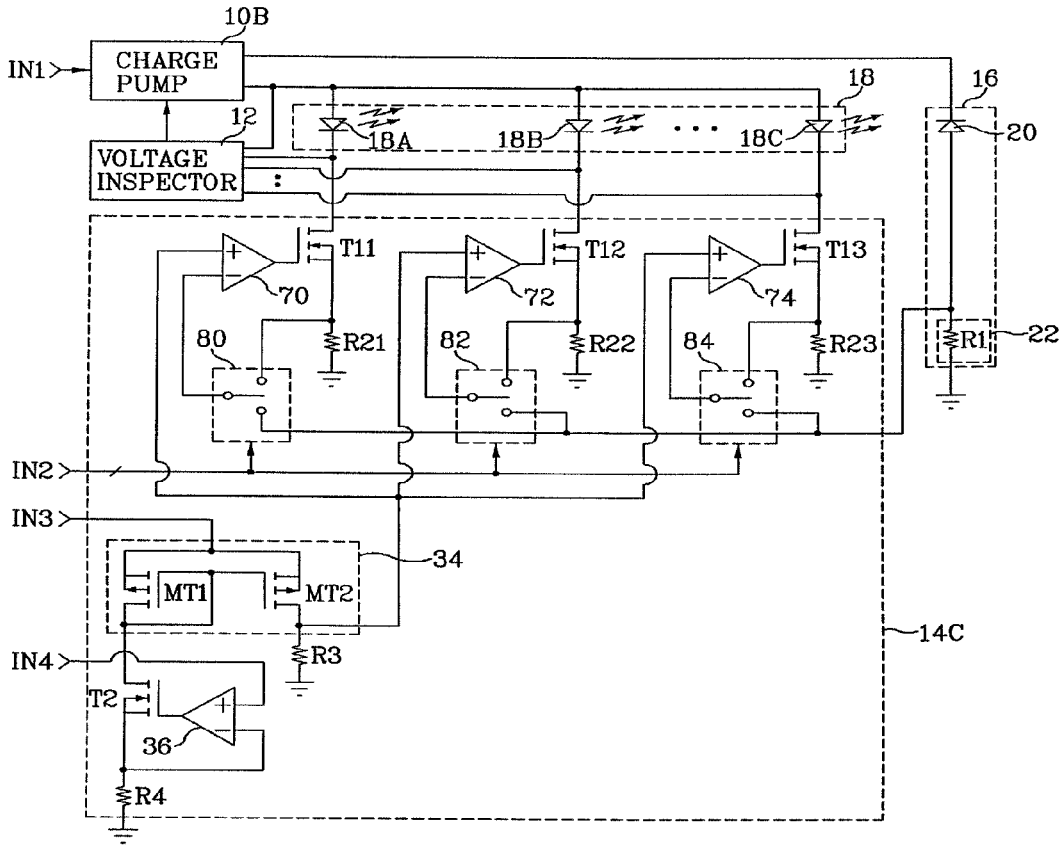

Example FIG. 6 is a circuit diagram of an LED driving circuit, according to embodiments.

Figure 7:
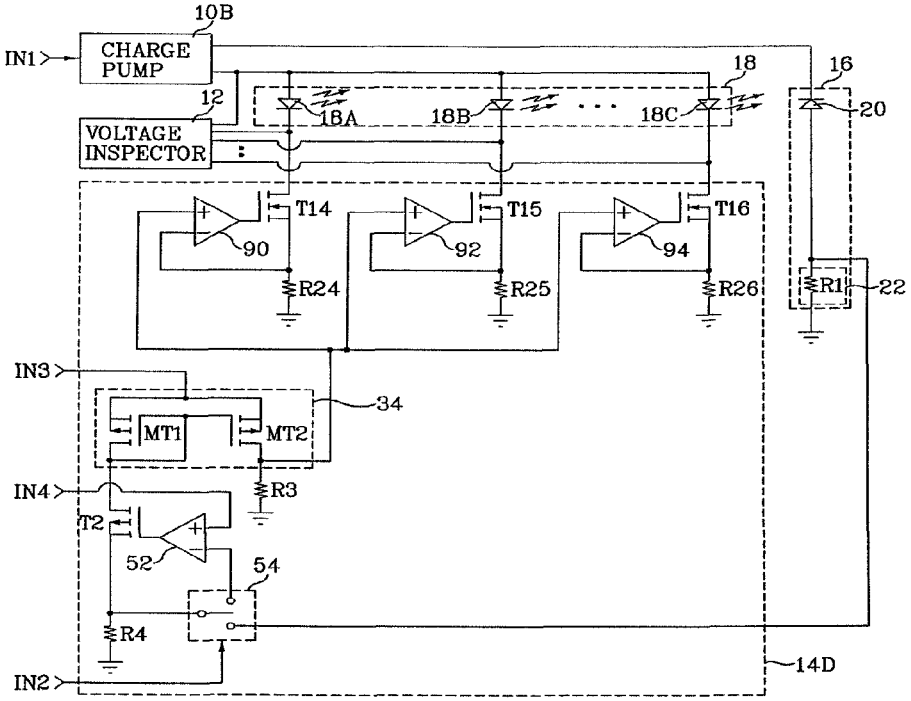

Example FIG. 7 is a circuit diagram of an LED driving circuit, according to embodiments.

DESCRIPTION

Example FIG. 1 is a schematic block diagram of an LED driving circuit, according to embodiments. In embodiments, an LED driving circuit illustrated in FIG. 1 may includes at least one of charge pump 10, voltage inspector 12, current regulator 14, and/or optical sensor 16. Voltage inspector 12 may inspect a voltage supplied to at least one LED 18. Voltage inspector 12 may generate a control signal from the inspected voltage. A generated control signal may be supplied to charge pump 10. For example, voltage inspector 12 may sense a voltage supplied to LED 18 and generate a control signal. In embodiments, voltage inspector 12 may check whether a voltage at both electrodes of the LED 18 is higher than a reference voltage and generate a control signal.

Charge pump 10 may supply to LED 18 a voltage corresponding to a control signal received from voltage inspector 12. For example, charge pump 10 may supply to corresponding LED 18 a voltage corresponding to an operation mode, which may be determined in response to the control signal associated with an operation mode (e.g. of a plurality of operation modes). Different operating modes may have different voltage gains according to an input voltage received externally through input terminal IN1. Charge pump 10 may be suitable when an operation voltage (e.g. 3 to 4 volts) of a white LED is higher than a battery voltage of a host device (e.g. a mobile communication device).

In embodiments, if it is determined through the control signal that the LED 18 is short of current, charge pump 10 may select an operation mode having a high voltage gain and supply a high voltage in the selected operation mode to LED 18. Since charge pump 10 may supply only an indispensable amount of current necessary for the output of LED 18, energy efficiency may be maximized.

Optical sensor 16 may receive light emitted from at least one LED 18. Optical sensor 16 may generate a feedback signal at a level corresponding to the amount of light received (e.g. sensed by optical sensor 16). Optical sensor 16 may supply the generated feedback signal to current regulator 14. Optical sensor 16 may be connected between charge pump 10 and current regulator 14, in accordance with embodiments. In embodiments, optical sensor 16 may be connected between both electrodes of LED 18 and current regulator 14. In embodiments where optical sensor 16 is connected between charge pump 10 and current regulator 14, charge pump 10 may supply power voltage to optical sensor 16.

Current regulator 14 may be provided on a path through which the current of LED 18 flows. For example, current regulator 14 may be provided between a negative electrode of LED 18 and a ground voltage (e.g. which may be a reference voltage). Current regulator 14 may compare the feedback signal received from optical sensor 16 with a first reference signal and may regulate the amount of current flowing into LED 18 according to the comparison. In embodiments, current regulator 14 may adjust the amount of current flowing into at least one LED 18 according to a comparison of the feedback signal from optical sensor 16 and the first reference signal (e.g. change the current level or maintain the current level).

Example FIG. 2 illustrates a circuit diagram of an LED driving circuit, according to embodiments. In embodiments, the LED driving circuit illustrated in FIG. 2 may include at least one of charge pump 10A, voltage inspector 12, optical sensor 16, and current regulator 14A. Example FIG. 3 illustrates a circuit diagram of an LED driving circuit, according to embodiments. In embodiments, the LED driving circuit illustrated in FIG. 3 may include at least one of charge pump 10B, voltage inspector 12, optical sensor 16, and current regulator 14A.

Example FIGS. 2 and 3 illustrate sensor 16 including at least one of light receiving diode 20 and first load 22, in accordance with embodiments. Light receiving diode 20 may receive light emitted from LED 18. As illustrated in example FIG. 2, light receiving diode 20 may have a negative electrode connected to a positive electrode of LED 18 and to charge pump 10A and light receiving diode 20 may have a positive electrode connected to the first load 22, in accordance with embodiments. As illustrated in example FIG. 3, light receiving diode 20 may have a negative electrode connected to charge pump 10B and have a positive electrode connected to first load 22, in accordance with embodiments. In embodiments, configurations and/or operations of LED driving circuits illustrated in example FIGS. 2 and 3 have some similarities. As illustrated in example FIG. 2, charge pump 10A supplies a first voltage to LED 18 and light receiving diode 20, in accordance with embodiments. As illustrated in example FIG. 3, charge pump 10B supplies a first voltage to LED 18 and supplies a second voltage to light receiving diode 20, in accordance with embodiments.

First load 22 may be connected to a positive electrode of light receiving diode 20 and a reference voltage. A feedback signal may be supplied to current regulator 14A. The feedback signal may be derived at the connection between light receiving diode 20 and the first load 22. As illustrated in FIGS. 2 and 3, when first load 22 includes first resistor R1 connected between the positive electrode of light receiving diode 20 and the reference voltage, the feedback signal corresponds to a voltage generated across both ends of first resistor R1, in accordance with embodiments.

Current regulator 14A illustrated in example FIGS. 2 and/or 3 may include first comparator 30, transistor T1, load R2, switch 32, and/or first reference signal generator 33A. First comparator 30 may compare the level of the feedback signal received from optical sensor 16 to a level of a first reference signal generated from first reference signal generator 33A. First comparator 30 may supply the compared result to transistor T1. First comparator 30 may include an operational amplifier (Op-Amp) having a negative input terminal connected to the feedback signal, a positive input terminal connected to the first reference signal, and an output terminal connected to the transistor T1.

Transistor T1 may be connected between the negative electrode of LED 18 and the reference voltage. Transistor T1 may be driven in response to the result of the comparison generated by first comparator 30. Load R2 may be connected between transistor T1 and the reference voltage. First reference signal generator 33A may generate the first reference signal. First reference signal generator 33A may supply the generated first reference signal to first comparator 30. First reference signal generator 33A may include Op-Amp 36, transistor T2, resistor R3, resistor R4, and current mirror 34.

Op-Amp 36 may have a positive input terminal connected to a second reference signal, where the second reference signal may be received through an input terminal IN4 and/or may serve as a voltage follower. Resistor R4 may be connected between a negative input terminal of Op-Amp 36 and the reference voltage. Transistor T2 may cause a reference current to flow into resistor R4 in response to the output of Op-Amp 36. For example, Op-Amp 36, resistor R4, and transistor T2 may function as a current regulator. In the current regulator, Op-Amp 36 may control transistor T2 to generate a fixed voltage across resistor R4, in accordance with embodiments.

Current mirror 34 may include transistor MT1 and/or transistor MT2. Current mirror 34 may generate a mirror current of the reference current flowing into transistor T2. Current mirror 34 may cause the generated mirror current to flow into resistor R3. A power voltage received through input terminal IN3 may be supplied to current mirror 34. Accordingly, the voltage of an end of resistor R3 may be supplied to the positive input terminal of the first comparator 30 as the first reference signal, in accordance with embodiments.

The LED driving circuit illustrated in FIGS. 2 and/or FIG. 3 may include a switch 32, in accordance with embodiments. Switch 32 may perform a switching operation in response to a selection signal received through input terminal IN2. Switch 32 may supply a feedback signal from optical sensor 16 to the negative terminal of first comparator 30 and/or supply a voltage from resistor R2 to the negative input terminal of first comparator 30.

The level of the feedback signal developed across resistor R1 may increase as the strength of light becomes stronger and decrease as the strength of light becomes weaker. Current regulator 14A may reduce the amount of current flowing into LED 18 when the level of the feedback signal is high and increase the amount of current flowing into LED 18 when the level of the feedback signal is low. The magnitude of a mirror current generated through current mirror 34 may be varied by adjusting the size of the resistor R4. When the LED driving circuit illustrated in FIG. 2 is part of an integrated circuit, resistor R4 may external to the integrated circuit, in accordance with embodiments.

Example FIG. 4 illustrates a circuit diagram of an LED driving circuit according to embodiments. In embodiments, the LED driving circuit illustrated in FIG.4 may include at least one of charge pump 10A, voltage inspector 12, optical sensor 16, and/or current regulator 14B. Example FIG. 5 iillustrates a circuit diagram of an LED driving circuit according to embodiments. In embodiments, the LED driving circuit illustrated in FIG. 5 may include at least one of charge pump 10B, voltage inspector 12, optical sensor 16, and/or current regulator 14B.

Charge pump 10A, charge pump 10B, voltage inspector 12, LED 18, and/or optical sensor 16 illustrated in FIG. 4 and/or FIG. 5 may be similar to those illustrated in example FIG. 2 or FIG. 3, in accordance with embodiments. In embodiments, light receiving diode 20 may have a negative electrode that is connected to a positive electrode of LED 18 and charge pump 10A, as illustrated in FIG. 4. Light receiving diode 20 may have a positive electrode connected to first load 22, as illustrated in FIG. 4. In embodiments, light receiving diode 20 may have a negative electrode connected to charge pump 10B and have a positive electrode connected to first load 22, as illustrated in FIG. 5. In embodiments, configurations and operations of LED driving circuits of FIGS. 4 and 5 may be similar.

Current regulator 14B illustrated in FIG. 4 and/or FIG. 5 may include second comparator 52, second reference signal generator 33B, Op-Amp 50, transistor T1, resistor R2, and/or switch 54. Second comparator 52 may compare a level of a feedback signal received from optical sensor 16 with a level of a first reference signal received through input terminal IN4. Second comparator 52 may supply the compared result to second reference signal generator 33B. Second comparator 30 may have a negative input terminal connected to the feedback signal, a positive input terminal connected to the first reference signal, and an output terminal connected to second reference signal generator 33B.

In embodiments, the LED driving circuit illustrated in FIG. 4 and/or FIG. 5 may include switch 54. Switch 54 may perform a switching operation in response to a selection signal received through input terminal IN2. Switch 54 may supply a feedback signal to the negative terminal of second comparator 52 or supplies a voltage from resistor R4 to the negative input terminal of second comparator 52.

Second reference signal generator 33B may generate a second reference signal from the comparison generated by second comparator 52. Second reference signal generator 33B may supply the generated second reference signal to a positive input terminal of Op-Amp 50. Second reference signal generator 33B may include transistor T2, resistor R3, resistor R4, and/or current mirror 34. Transistor T2 may be provided on a path through which a reference current flows. Transistor T2 may be driven in response to the comparison result generated by second comparator 52. Resistor R4 may be connected between transistor T2 and a reference voltage. Current mirror 34 may generate a mirror current of the reference current. Current mirror 34 may cause the generated mirror current to flow into resistor R3. In embodiments, the second reference signal generated from second reference signal generator 33B may corresponds to a voltage across resistor R3.

Op-Amp 50 may have a positive input terminal connected to the second reference signal. Op-Amp 50 may serve as a voltage follower. Transistor T1 may be connected between the negative electrode of LED 18 and a negative input terminal of Op-Amp 50. Transistor T1 may be driven in response to an output of Op-Amp 50. Load R2 may be connected between the negative input terminal of Op-Amp 50 and the reference voltage. In embodiments, Op-Amp 50, resistor R2, and transistor T1 may function as a current regulator. In the current regulator, Op-Amp 50 may control transistor T1 such that a fixed voltage is generated across resistor R2.

Example FIG. 6 illustrates a circuit diagram of an LED driving circuit according to embodiments. In embodiments, the LED driving circuit illustrated in FIG. 6 may include charge pump 10B, voltage inspector 12, LED 18, optical sensor 16, and/or current regulator 14C. In embodiments, the LED driving circuit illustrated in FIG. 3 may drives only one LED, whereas the LED driving circuit illustrated in FIG. 6 may drive a plurality of LEDs 18A, 18B, and/or 18C. In embodiments, although the LED driving circuit illustrated in FIG. 6 adjusts current of each of LEDs 18A, 18B, and 18C, the LED driving circuit illustrated FIG. 6 may perform similar operations as the LED driving circuit illustrated in FIG. 3.

Light receiving diode 20 may receive light emitted from LEDs 18A, 18B, and 18C. In embodiments, first comparators 70, 72, and 74, transistors T11, T12, and T13, switches 80, 82, and 84, and resistors R21, R22, and R23 may be provided with respect to LEDs 18A, 18B, and 18C, respectively. Operation of each of first comparators 70, 72, and 74 may be similar to the operation of first comparator 30 illustrated in example FIG. 3, in accordance with embodiments. In embodiments, the operation of each of transistors T11, T12, and T13 may be similar to the operation of transistor T1 illustrated in example FIG. 3. In embodiments, a LED driving circuit illustrated in FIG. 6 may regulate the amount of current flowing into each LED.

In embodiments, first comparator 70, transistor T11, and resistor R21 may adjust the current of LED 18A. First comparator 72, transistor T12, and resistor R22 may adjust the current of LED 18B. First comparator 74, transistor T13, and resistor R23 may adjust the current of LED 18C. Although a negative electrode of light receiving diode 20 may be connected to charge pump 10B in FIG. 6, it may also be connected to a positive electrode of each of the LEDs, in accordance with embodiments.

Example FIG. 7 illustrates a circuit diagram of an LED driving circuit according to embodiments. In embodiments, the LED driving circuit illustrated in FIG. 7 may include charge pump 10B, voltage inspector 12, LED 18, optical sensor 16, and/or current regulator 14D. In embodiments, the LED driving circuit illustrated in FIG. 5 may drive one LED, whereas the LED driving circuit illustrated in FIG. 7 may drive a plurality of LEDs 18A, 18B, and 18C. In embodiments, although the LED driving circuit illustrated in FIG. 7 adjusts the current of each of the LEDs 18A, 18B, and 18C, the LED driving circuit illustrated in FIG. 7 may perform similar operations as the LED driving circuit illustrated in FIG. 5.

Light receiving diode 20 may receive light emitted from LEDs 18A, 18B, and 18C. Op-Amps 90, 92, and 94, transistors T14, T15, and T16, and resistors R24, R25, and R26 may be provided with respect to LEDs 18A, 18B, and 18C, respectively. The operation of each of Op-Amps 90, 92, and 94 may be similar to the operation of Op-Amp 50 illustrated in FIG. 5, in accordance with embodiments. In embodiments, the operation of each of transistors T14, T15, and T16 may be similar to the operation of transistor T1 illustrated in FIG. 5.

OP-Amp 90, transistor T14, and resistor R24 may adjust the current of LED 18A. Op-Amp 92, transistor T15, and resistor R25 may adjust the current of LED 18B. Op-Amp 94, transistor T16, and resistor R26 may adjust the current of LED 18C. In embodiments, although a negative electrode of light receiving diode 20 is connected to charge pump 10B illustrated in FIG. 7, it may also be connected to a positive electrode of each of the LEDs. In embodiments, the LED driving circuit illustrated in FIG. 6 may control the amount of current flowing into the LEDs individually, whereas the LED driving circuit illustrated in FIG. 7 may control the amount of current flowing into LEDs 18A, 18B, and 18C as a whole. Although FIGS. 6 and 7 illustrate only three LEDs, embodiments may include any practical amount of LEDs and associated circuitry.

In the LED driving circuits illustrated in FIGS. 1 to 7, components may be integrated into an integrated circuit, in accordance with embodiments. In embodiments, components (e.g. LED 18, light receiving diode 20, and/or resistor R4) may be external to an integrated circuit. Charge pump 10A and/or 10B may receive a power voltage through input terminal IN1 outside an integrated circuit, in accordance with embodiments. Current regulators 14A to 14D may receive the power voltage through input terminals IN3 and IN4 inside or outside an integrated circuit. In embodiments, a voltage may be input through input terminal IN4 and may be generated from a band gap reference circuit. U.S. Pat. No. 6,690,146 entitled "High Efficiency LED Driver" relates to a band gap reference circuit and is hereby incorporated by reference in its entirety.

In embodiments, transistors T1, T2, T11, T12, T13, T14, T15, and/or T16 may be constructed by N-type metal oxide semiconductor (MOS) field effect transistors (FETs). In embodiments, transistors MT1 and MT2 may be constructed by P-type MOS FETs. However, embodiments relate to transistors of any type. In embodiments, switches 32, 54, 80, 82, and/or 84 may be omitted, as well as other components.

In embodiments, the LED driving circuit illustrated in example FIG. 2 and/or example FIG. 4 has a relatively simple configuration compared to the LED driving circuit illustrated in example FIG. 3 and/or example FIG. 5 due to charge pump 10A supplying only one voltage. Accordingly, in embodiments, the operation of the circuit illustrated in example FIG. 3 and/or example FIG. 5 may be relatively more stable than the circuits illustrated in example FIG. 2 and/or example FIG.5, because the negative electrode of light receiving diode 20 is connected to the positive electrode of LED 18.

In embodiments, although the LED driving circuit illustrated in example FIG. 3 and/or FIG. 5 may be relatively more stable than the circuit illustrated in example FIG. 2 and/or FIG. 4 because the negative electrode of light receiving diode 20 is connected to charge pump 10B, an additional voltage for light receiving diode 20 may need to be applied by charge pump 10B. However, in embodiments, circuits illustrated in example FIG. 3, FIG. 5, FIG. 6, and/or FIG. 7, charge pump 10B may control the amount of voltage supplied to light receiving diode 20 and the magnitude of current flowing into light receiving diode 20 may be regulated. In embodiments, the circuit illustrated in FIG. 3, FIG. 5, FIG. 6, and/or FIG. 7 may have desirable integration attributes because a value of resistor R1 may be relatively low if a level of a voltage supplied to light receiving diode 20 from charge pump 10B is minimized.

In embodiments, a LED driving circuit may regulate the amount of current flowing into LED 18 by a relatively small number of devices by sensing a voltage supplied to the LED 18. Accordingly, an optical output of LED 18 may compensate for aging and/or temperature variations of LED 18. In embodiments, the amount of current flowing into LED 18 may be regulated by a relatively small number of devices by sensing a voltage across both ends of LED 18 and/or the magnitude of light emitted from LED 18. A LED driving circuit in accordance with embodiments may maintain a relatively consistent optical output from a LED by reducing variation in the optical output of the LED according to aging and temperature variation of the LED.

It will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. An apparatus comprising a light emitting diode (LED) driving circuit configured to drive at least one LED, wherein the circuit comprises:

an optical sensor configured to receive light emitted from said at least one LED and generate a feedback signal corresponding to an amount of light received by the optical sensor; and a current regulator configured to regulate an amount of current flowing into said at least one LED according to a comparison of the feedback signal with a first reference signal, wherein the current regulator comprises:

a first reference signal generator configured to generate the first reference signal, a comparator configured to compare a level of the feedback signal with a level of the first reference signal;

a first transistor connected between a negative electrode of said at least one LED and a reference voltage source, where the first transistor is driven in response to the comparison of the feedback signal with the first reference signal; and a first load connected between the first transistor and the reference voltage source, wherein the first reference signal generator comprises:

an operational amplifier comprising a positive input terminal configured to receive a second reference signal;

a second load connected between a negative input terminal of the operational amplifier and the reference voltage source;

a second transistor configured to supply a reference current to the second load in response to an output of the operational amplifier;

a current mirror configured to generate a mirror current of the reference current; and a first resistor, wherein the mirror current flows into the first resistor and wherein the first reference signal corresponds to a voltage across both ends of the first resistor.

2. The apparatus of claim 1, wherein the reference voltage source is grounded.

3. The apparatus of claim 1, comprising a switch configured to selectively supply the feedback signal to the current regulator.

4. The apparatus of claim 1, wherein the current regulator is connected between a negative electrode of said at least one LED and the reference voltage source.

5. The apparatus of claim 4, wherein the reference voltage source is grounded.

6. The apparatus of claim 1, comprising:

a voltage inspector configured to inspect a voltage of said at least one LED and generate a control signal; and a charge pump configured to supply a voltage to said at least one LED according to the control signal.

7. The apparatus of claim 2, wherein:

the charge pump is configured to supply to said at least one LED the voltage corresponding to an operation mode; and the operation mode is determined according to the control signal designating one of a plurality of operation modes having different voltage gains.

8. The apparatus of claim 2, wherein the voltage of said at least one LED is a voltage supplied to said at least one LED.

9. The apparatus of claim 6, wherein the voltage of said at least one LED is a voltage across both electrodes of said at least one LED.

10. The apparatus of claim 1, wherein the optical sensor comprises:

a light receiving diode configure to receive light emitted from said at least one LED; and a third load connected between the light receiving diode and the reference voltage source, wherein the feedback signal is derived from a voltage at a connection point of the light receiving diode and the third load.

11. The apparatus of claim 10, wherein the reference voltage source is grounded.

12. The apparatus of claim 10, wherein the light receiving diode comprises:

a negative electrode connected to a charge pump; and a positive electrode connected to the third load.

13. The apparatus of claim 10, wherein the light receiving diode comprises:

a negative electrode connected to a positive electrode of said at least one LED; and a positive electrode connected to the third load.

14. The apparatus of claim 10, wherein:

the first load comprises a second resistor connected between a positive electrode of the light receiving diode and the reference voltage source; and the feedback signal is a voltage across both ends of the second resistor.

15. An apparatus comprising light emitting diode (LED) driving circuit configured to drive at least one LED, wherein the circuit comprises:

an optical sensor configured to receive light emitted from said at least one LED and generate a feedback signal corresponding to an amount of light received by the optical sensor; and a current regulator configured to regulate an amount of current flowing into said at least one LED according to a comparison of the feedback signal with a first reference signal, wherein the current regulator comprises:

a comparator configured to compare the feedback signal with the first reference signal;

a reference signal generator configured to generate a second reference signal in response to the comparison of the feedback signal with the first reference signal;

an operational amplifier comprising a positive input terminal connected to the reference signal generator;

a first transistor connected between a negative electrode of said at least one LED and a reference voltage source, wherein the first transistor is driven by an output of the operational amplifier; and a load connected between a negative input terminal of the operational amplifier and the reference voltage source, wherein reference signal generator comprises:

a second transistor through which a reference current flows, wherein the second transistor is driven in response to the comparison of the feedback signal with the first reference signal;

a first resistor connected between the second transistor and the reference voltage source;

a current mirror configured to generate a mirror current of the reference current; and a second resistor, wherein the mirror current flows into the second transistor and wherein the second reference signal corresponds to a voltage across both ends of the second resistor.

16. The apparatus of claim 15, wherein the reference voltage source is grounded.

* * * * *